US009484654B2

(12) United States Patent
Du et al.

(10) Patent No.: US 9,484,654 B2
(45) Date of Patent: Nov. 1, 2016

(54) ELECTRICAL CONNECTOR WITH IMPROVED CONTACTS

(71) Applicant: FOXCONN INTERCONNECT TECHNOLOGY LIMITED, Grand Cayman (KY)

(72) Inventors: Xiao-Bo Du, Kunshan (CN); Chun-Ming Yu, Kunshan (CN); Liang Gong, Kunshan (CN); Qi-Sheng Zheng, Kunshan (CN); Xiao-Bo Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/684,223

(22) Filed: Apr. 10, 2015

(65) Prior Publication Data

US 2015/0295335 A1 Oct. 15, 2015

(30) Foreign Application Priority Data

Apr. 10, 2014 (CN) ..... 2014 2 0171343 U
Jun. 3, 2014 (CN) ..... 2014 2 0289926 U

(51) Int. Cl.

| | |
|---|---|
| ***H01R 13/11*** | (2006.01) |
| ***H01R 13/428*** | (2006.01) |
| ***H01R 13/6585*** | (2011.01) |
| *H01R 12/72* | (2011.01) |
| *H01R 13/436* | (2006.01) |
| *H01R 24/58* | (2011.01) |

(52) U.S. Cl.

CPC ..... *H01R 13/112* (2013.01); *H01R 13/428* (2013.01); *H01R 13/6585* (2013.01); *H01R 12/724* (2013.01); *H01R 13/4367* (2013.01); *H01R 24/58* (2013.01)

(58) Field of Classification Search

CPC ..... H01R 13/112
See application file for complete search history.

(56) References Cited

U.S. PATENT DOCUMENTS

| | | | | | |
|---|---|---|---|---|---|
| 4,493,525 | A * | 1/1985 | Hall | H01R 9/032 | 439/607.47 |
| 4,568,133 | A * | 2/1986 | Amano | H01R 13/6485 | 439/108 |
| 4,611,878 | A * | 9/1986 | Hall | H01R 9/032 | 439/353 |
| 4,634,208 | A * | 1/1987 | Hall | H01R 9/032 | 439/607.51 |
| 4,637,669 | A * | 1/1987 | Tajima | H01R 23/6873 | 200/51.07 |
| 4,695,105 | A * | 9/1987 | Ney | H01R 23/6873 | 333/185 |
| 4,842,554 | A * | 6/1989 | Cosmos | H01R 23/6873 | 439/607.17 |

(Continued)

FOREIGN PATENT DOCUMENTS

TW M299962 10/2006

*Primary Examiner* — Ross Gushi
(74) *Attorney, Agent, or Firm* — Wei Te Chung; Ming Chieh Chang

(57) ABSTRACT

An electrical connector comprises an insulative housing with a plurality of ports, a plurality of contacts received in the insulative housing, a rear seat assembled to a rear side of the insulative housing and a metal shell covering the insulative housing. The insulative housing has a plurality of slots recessed from a rear surface thereof for retaining the contacts. The contact has a linking portion positioned in the rear sear and a mating portion bent from the linking portion and exposed in the port. The mating portions of the contacts in a same port are located in different heights, and at least one of the mating potions is inclined, so as to provide an inclined force to an inserted mating connector thereby reducing a pressing force to the inserted plug during engaging.

20 Claims, 9 Drawing Sheets

(56) References Cited

U.S. PATENT DOCUMENTS 4,842,555 A * 6/1989 Cosmos ..... H01R 13/627 174/359
4,894,026 A * 1/1990 Dixon ..... H01R 13/65802 439/607.17
4,908,335 A * 3/1990 Cosmos ..... H01R 12/716 439/444
4,913,664 A * 4/1990 Dixon ..... H01R 13/65802 439/607.28
4,946,400 A * 8/1990 Kawai ..... H01R 13/506 439/79
4,983,127 A * 1/1991 Kawai ..... H01R 23/6873 439/79
5,022,871 A * 6/1991 Sekiguchi ..... H01R 23/6873 439/607.19
5,035,651 A * 7/1991 Dixon ..... H01R 13/65802 439/607.17
5,037,330 A * 8/1991 Fulponi ..... H01R 23/6873 439/541.5
5,041,022 A * 8/1991 Sekiguchi ..... H01R 13/627 439/353
5,178,562 A * 1/1993 Ermini ..... H01R 13/65802 439/149
5,186,633 A * 2/1993 Mosser, III ..... H01R 12/57 439/79
5,192,228 A * 3/1993 Collins ..... H01R 23/6873 439/567
5,281,169 A * 1/1994 Kiat ..... H01R 12/712 439/607.35
D344,263 S * 2/1994 Seido ..... H01R 23/6873 D13/154
5,288,248 A * 2/1994 Chen ..... H01R 23/6873 439/108
5,417,585 A * 5/1995 Morin ..... H01R 13/465 439/488
5,622,523 A * 4/1997 Kan ..... H01R 13/6485 439/607.37
5,902,151 A * 5/1999 Havener ..... H01R 43/205 439/607.35
5,908,331 A * 6/1999 Hsu ..... H01R 13/65802 439/607.28
5,913,698 A * 6/1999 Keng ..... H01R 13/65802 439/607.17
D416,862 S * 11/1999 Chiou ..... H01R 13/65802 D13/146
5,984,727 A * 11/1999 Wu ..... H01R 13/65802 439/607.02
6,074,218 A * 6/2000 Wu ..... H01R 24/58 439/607.01
6,109,966 A * 8/2000 Chiou ..... H01R 12/722 439/607.03
6,126,481 A * 10/2000 Wu ..... H01R 13/514 439/541.5
6,149,459 A * 11/2000 Yang ..... H01R 13/5213 439/541.5
6,179,653 B1 * 1/2001 Cheng ..... H01R 12/716 439/541.5
6,227,904 B1 * 5/2001 Wang ..... H01R 13/65802 439/540.1
6,227,905 B1 * 5/2001 Tsai ..... H01R 12/716 439/188
6,234,833 B1 * 5/2001 Tsai ..... H01R 13/506 439/188
6,234,834 B1 * 5/2001 Tsai ..... H01R 13/514 439/101
6,234,841 B1 * 5/2001 Chang ..... H01R 13/65802 439/607.25
6,264,501 B1 * 7/2001 Hung ..... H01R 27/02 439/541.5
6,343,941 B1 * 2/2002 Kan ..... H01R 13/65802 439/95
6,508,665 B1 * 1/2003 Yeh ..... H01R 13/6658 439/541.5
6,524,130 B1 * 2/2003 Yeh ..... H01R 13/518 439/108
6,666,716 B2 * 12/2003 Chien-Chung ..... H01R 12/724 439/101
6,688,913 B2 * 2/2004 Li ..... H01R 23/6873 439/541.5
6,695,644 B2 * 2/2004 Zhao ..... H01R 24/50 439/580
6,764,338 B2 * 7/2004 Fang ..... H01R 12/721 439/607.2
6,790,095 B2 * 9/2004 Liu ..... H01R 24/58 439/620.01
6,837,742 B1 * 1/2005 Chou ..... H01R 13/514 439/541.5
6,854,983 B2 * 2/2005 Kikuchi ..... H01R 24/50 439/629
6,887,099 B1 * 5/2005 Tung ..... H01R 12/727 439/541.5
6,921,291 B2 * 7/2005 Shih ..... H01R 24/50 439/101
6,997,742 B1 * 2/2006 Tung ..... H01R 13/514 439/101
7,008,261 B2 * 3/2006 Xue ..... H01R 12/716 439/540.1
7,008,266 B2 * 3/2006 Fang ..... H01R 12/721 439/607.35
7,029,329 B1 * 4/2006 Huang ..... H01R 13/514 439/541.5
7,178,230 B2 * 2/2007 Tsai ..... H01R 13/659 29/592.1
7,192,198 B1 * 3/2007 Chen ..... G02B 6/32 385/76
7,470,146 B1 * 12/2008 Chen ..... H01R 12/716 439/541.5
7,473,110 B1 * 1/2009 Wu ..... H01R 13/41 439/79
7,484,996 B2 * 2/2009 Ju ..... H01R 24/58 439/541.5
7,507,115 B2 * 3/2009 Ju ..... H01R 12/58 439/541.5
7,510,430 B2 * 3/2009 Zhang ..... H01R 12/58 439/541.5
7,651,344 B2 * 1/2010 Wu ..... H01R 13/6585 439/626
7,661,991 B1 * 2/2010 Sun ..... H01R 12/58 439/607.55
7,717,755 B2 * 5/2010 Zhang ..... H01R 24/58 439/669
7,726,990 B2 * 6/2010 Wang ..... H01R 24/58 200/51.09
7,753,738 B2 * 7/2010 Zhang ..... H01R 13/52 439/519
7,878,864 B2 * 2/2011 Wang ..... H01R 13/7033 439/668
7,922,538 B2 * 4/2011 Chang ..... G06F 3/162 439/577
8,257,116 B2 * 9/2012 Zhu ..... H01R 24/58 439/541.5
8,920,196 B2 * 12/2014 Li ..... H01R 13/6467 439/607.11
9,124,014 B2 * 9/2015 Zhang ..... H01R 13/41
2002/0052148 A1 * 5/2002 Nagata ..... H01R 24/58 439/668
2002/0052149 A1 * 5/2002 Suzuki ..... H01R 24/78 439/668
2003/0211776 A1 * 11/2003 Lin ..... H01R 12/724 439/541.5
2004/0180574 A1 * 9/2004 Liu ..... H01R 23/6873 439/541.5
2004/0259414 A1 * 12/2004 Shih ..... H01R 24/50 439/541.5
2006/0079114 A1 * 4/2006 Tsai ..... H01R 13/659 439/394
2009/0149080 A1 * 6/2009 Wu ..... H01R 12/57 439/668
2009/0275245 A1 * 11/2009 Zhang ..... H01R 24/58 439/701
2015/0295335 A1 * 10/2015 Du ..... H01R 13/428 439/660

* cited by examiner

ELECTRICAL CONNECTOR WITH IMPROVED CONTACTS

BACKGROUND OF THE INVENTION

1. Field of the Invention

The present invention relates to electrical connectors, more particularly to an electrical connector with improved contacts.

2. Description of Related Art

A related connector discloses in TAIWAN Patent NO. M299962, issued on Oct. 21, 2006, comprises an insulative housing, a plurality of contacts received in the insulative housing and a metal cover covering the insulative housing. The contacts has a pair of sound contacts and a pair of detection pins, each of the contacts has a contacting portion for electrically contacting with a mating connector, and the contacting portions of the sound contacts are located in a same high, the contacting portions of the detection pins are disposed along an upper to lower direction.

BRIEF SUMMARY OF THE INVENTION

According to one aspect of the present invention, an electrical connector comprises an insulative housing with a port and a plurality of contact slots, a plurality of contacts mounted to the contact slots of the insulative housing, and a metal shell covering the insulative housing. The contacts have two sound contacts and two detent pins, each contact is formed with a linking portion extending downwardly beyond the insulative housing and a mating portion bent forwardly from the linking portion and extending into the port of the insulative housing. The mating portions of the detent pins and one of the sound contacts are located at three different horizontal planes, while the other mating portion of the sound contact is located at an inclined plane relative to the horizontal planes.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
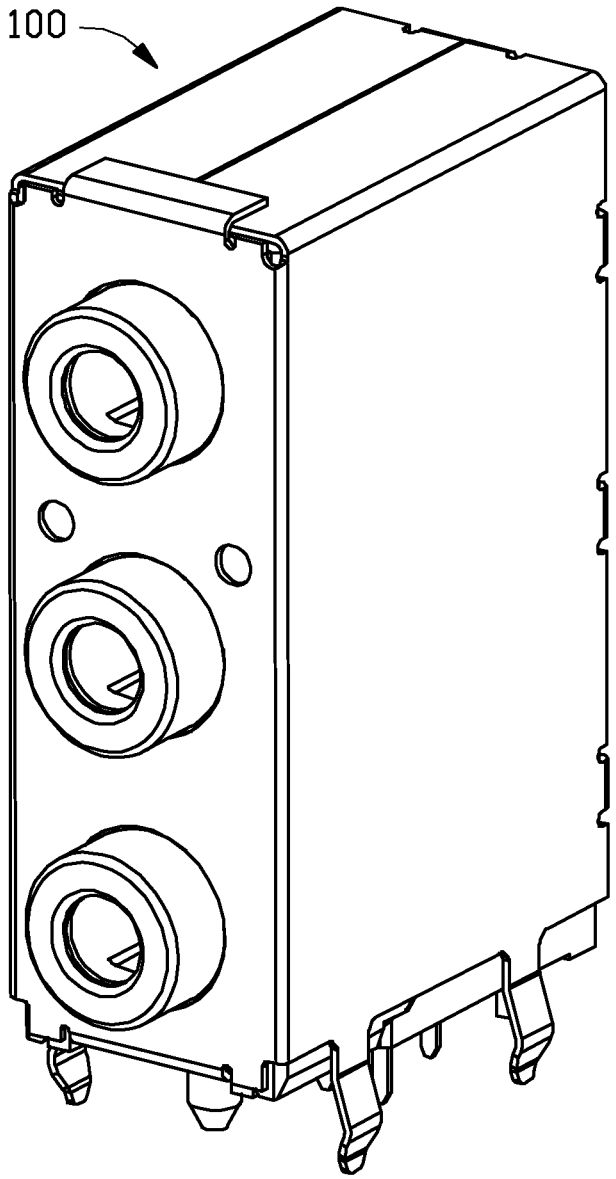
FIG. 1 is an assembled, perspective view of an electrical connector according to the present invention.

In the following description, numerous specific details are set forth to provide a thorough understanding of the present invention. However, it will be obvious to those skilled in the art that the present invention may be practiced without such specific details. Reference will be made to the drawing figures to describe the present invention in detail, wherein depicted elements are not necessarily shown to scale and wherein like or similar elements are designated by same or similar reference numeral through the several views and same or similar terminology.

Figure 2:
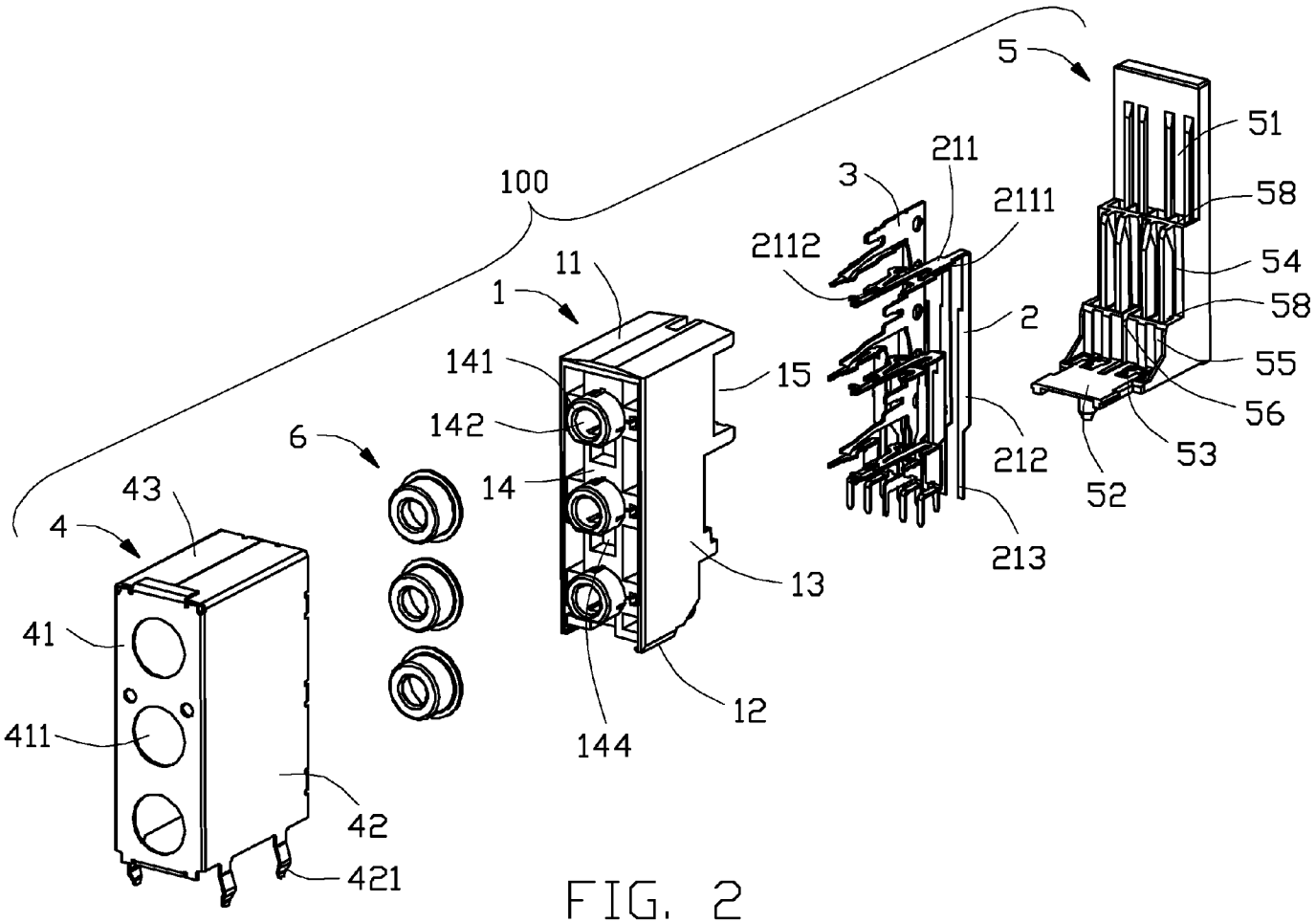
FIG. 2 is an explored, perspective view of the electrical connector.

Referring to FIG. 1 and FIG. 2, the electrical connector 100 in accordance with present invention comprises an insulative housing 1, a plurality of contacts received in the insulative housing 1, a grounding piece 3 and a metal shell 4 covering the insulative housing 1. The electrical connector 100 further has a rear seat 5 assembled to the insulative housing 1 and a cap 6 disposed between the insulative housing 1 and the metal shell 4.

Figure 3:
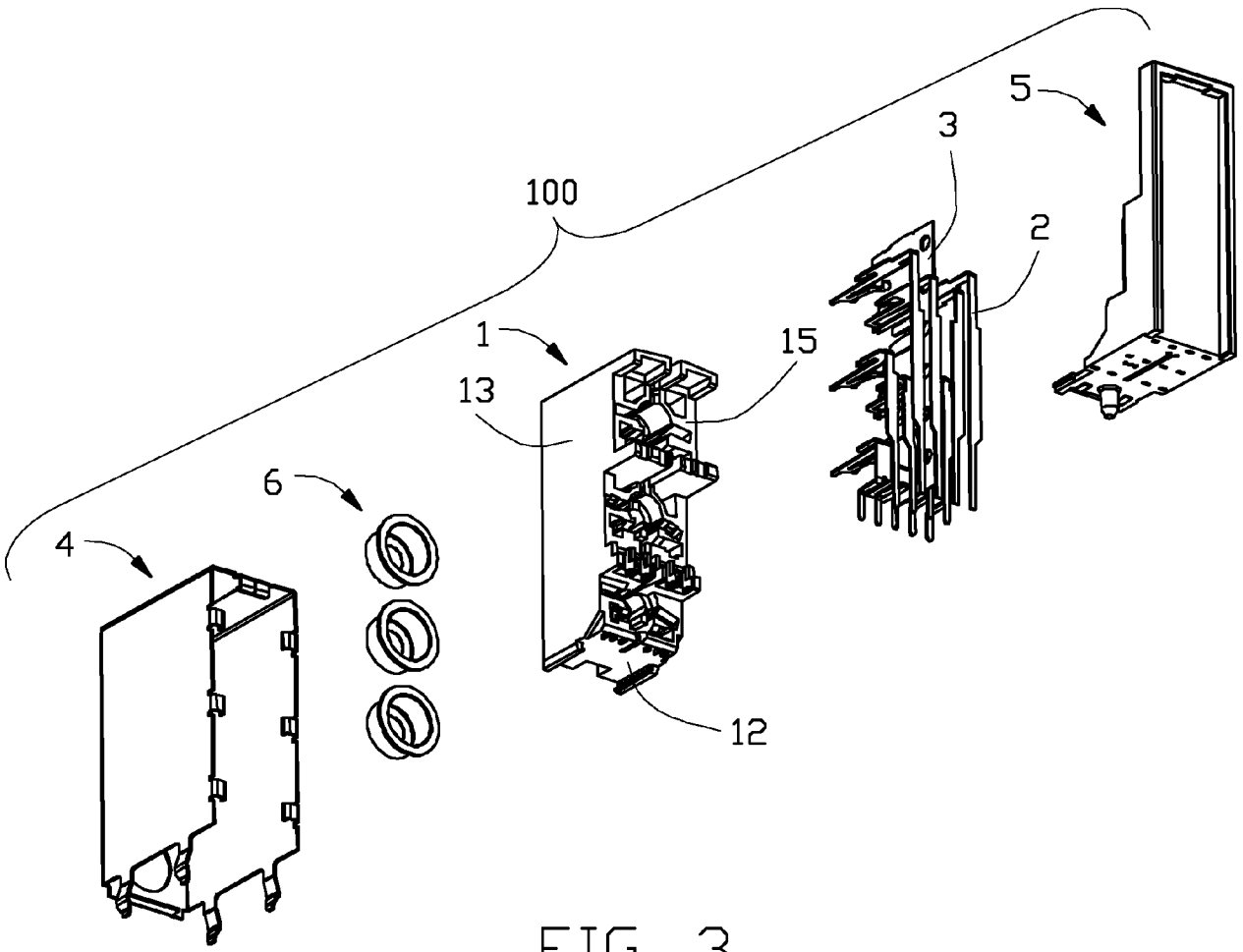
FIG. 3 is another explored, perspective view of the electrical connector taken from a bottom side.
Figure 4:
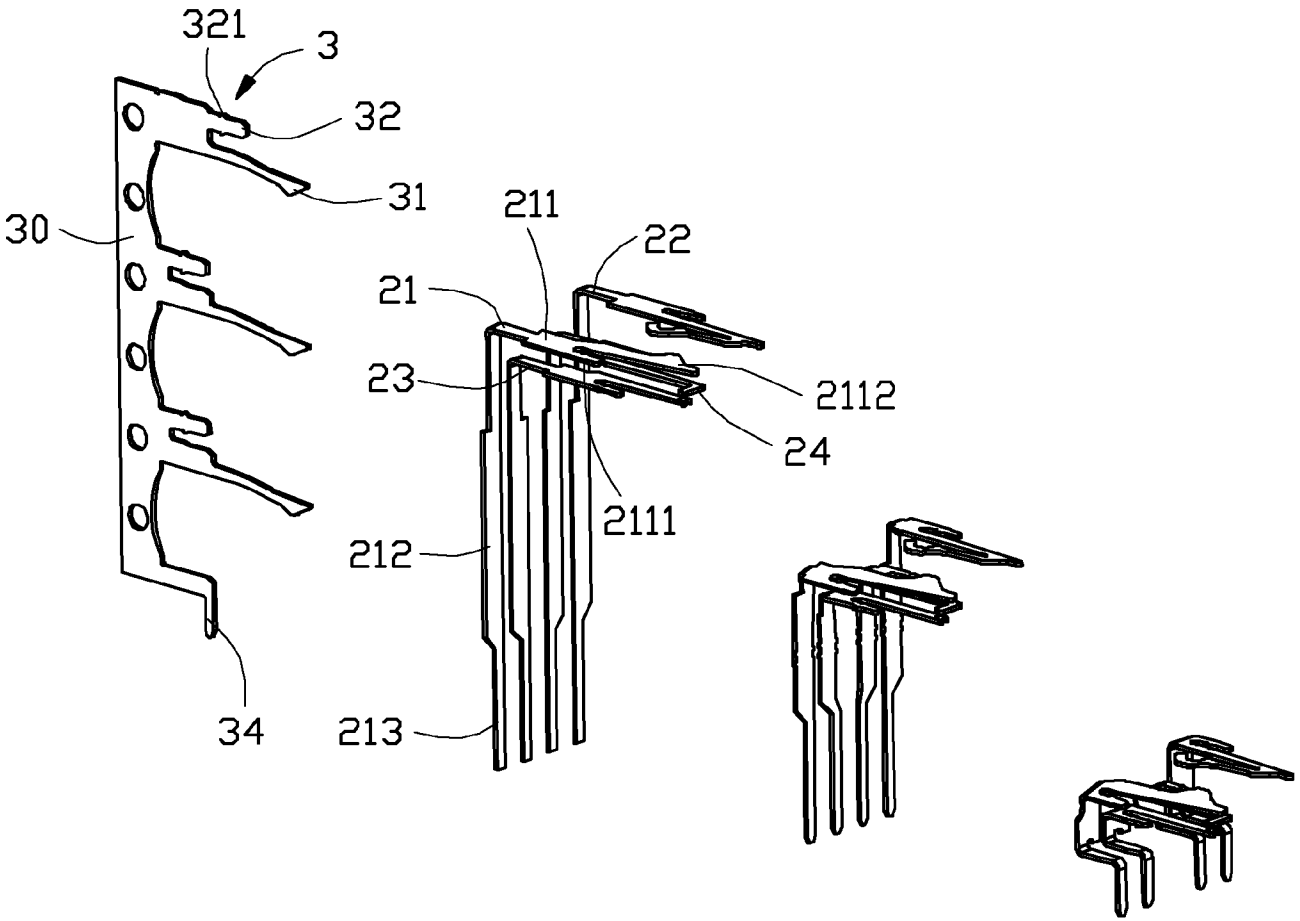
FIG. 4 is a perspective view of a grounding piece and contacts of the electrical connector

Referring to FIG. 2 and FIG. 3, the insulative housing 1 has a rectangular shape, and has a top face 11 and a bottom face 12 opposite to the top face 11 and two lateral surfaces 13 connecting the top face 11 and the bottom face 12, a front face 14 and a rear face 15 opposite to the front face 14. The insulative housing 1 has a plurality of tubers 141 protruding from the front face 14, these tubers 141 are aligned along an upper to lower direction, there are three tubers 141 in present embodiment, each tuber 141 defines a port 142 for engaging with a mating connector. The tuber 141 is integrated with a cantilever arm 143 extending into the port 142. The insulative housing 1 further has an opening 144 extending from the front face 14 and backwardly therethrough, and located below the tuber 141.

Figure 5:
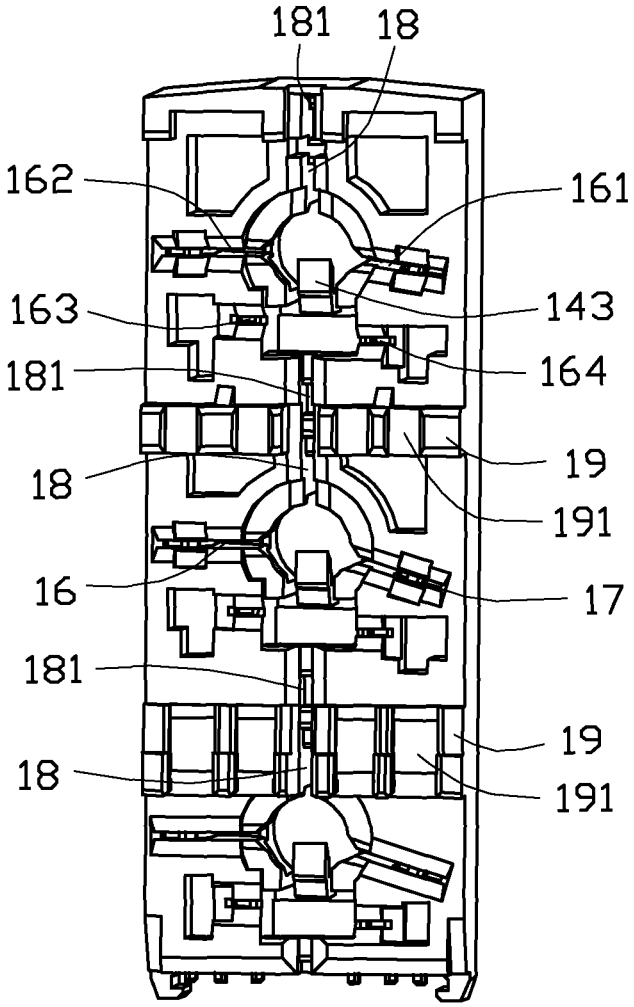
FIG. 5 is a rear view of the electrical connector without grounding piece and the contacts.

Conjoined with FIG. 5, the insulative housing 1 define a plurality contact slots 16 extending forwardly from the rear face 15 and lined in three rows. There are four contact slots 16 in each row, comprising a first slot 161, a second slot 162, a third slot 163 and a fourth slot 164. The first and the second slots 161, 162 are beside the port 142, the third and the fourth 163, 164 are beside the opening 144. The first and the second slots 161, 162 communicate with the port 142 forwardly. A mounting slot 17 is defined in the contact slot 16 and is further recessed forwardly. As observed from a rear side, each of the first, the second, the third, and the fourth slots 161, 162, 163, 164 is located in a different height, and the first slot 161 is inclined. The insulative housing 1 has a plurality of receiving slots 18 on a rear side, which is also forwardly communicated with the port 142 and has a retaining slot 181 on a top of the receiving slot 14. The insulative housing 1 further has a plurality of protrusion 19 protruding from the rear face 15 and disposed between the port 142, each of the protrusion 19 has a fastening slot 191 for fastending the contacts 2.

Conjoined with FIG. 3, the grounding piece 3 is stamped from a metal sheet, comprises a base 30 in a vertical plane, and three touching portions 31 extending from a side of the base 30, a fixing portion 43 and a tail 34 extending from a bottom of the base 30. The fixing portion 32 is located over the touching portion 31, and has barbs 321. The touching potions 31 are received in the receiving slots 18, and the bards 321 engage with the retaining slots 181 to retain the grounding piece 3 in the insulative housing 1.

The contacts 2 has three groups, each group consisted of two sound contacts and two detection pins, comprising a first contact 21 in the first slot 161, a second contact 22 in the second slot 162, a third contact 23 in the third slot 163 and a fourth contact 24 in the fourth slot 164. The first and the second contacts are sound contacts, and the third and the fourth contacts are detection pins. All of the first, the second, the third and the fourth contacts 21, 22, 23, 24 are stamped from a same contact strip by one time.

Figure 6:
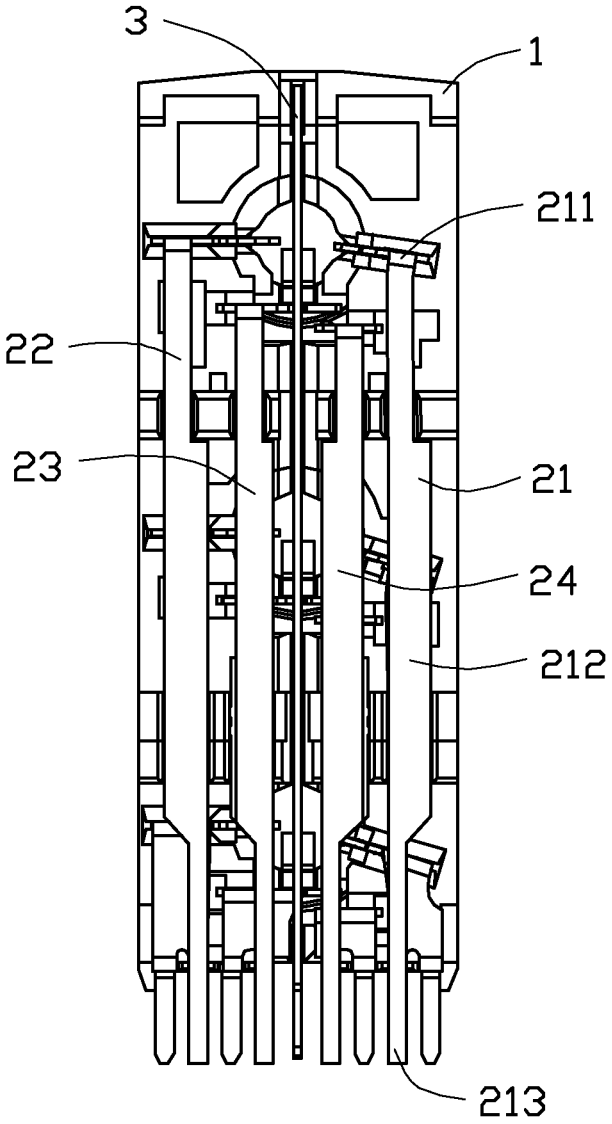
FIG. 6 is another rear view of the electrical connector.

Referring to FIGS. 5-6, each of the contacts 2 has a linking portion 212 in the rear seat 5, a soldering portion 213 extending downwardly beyond the rear sear 5 and a mating portion 211 bent forwardly from the other end of the linking portion 212 and received in the contact slot 16. Each mating portion 211 of the contacts 2 has a different bending height, and the mating portions 211 of the first contact 21 extends aslant relative to a horizontally direction, in fact, the corresponding bending line of the mating portions 211 of the first contact 21 with the corresponding linking portion 212 is not a horizontally line but an inclined line, referring to FIG. 9 also. The mating portion 211 of the first contact is inclined, so as to provide an inclined force to an inserted mating connector, that can reduce a pressing force to the mating connector during inserting/withdrawing the mating connector.

Each mating portion 211 has a fastening arm 2111 and an elastic (contacting) arm 2112 extending from a side of the fastening arm 2111 and forming a fork shape with the fastening arm 2111, wherein the elastic arm 2112 of the first contact 21 extends forwardly and aslant disposed relative to the horizontal plane. The elastic arm 2112 of the third contact 23 is located over the elastic arm 2112 of the fourth contact 24 and below the cantilever arm 143. The contacts 2 are assembled into the insulative housing 1, the fastening arm 2111 is fixed into the mounting slot 17, the elastic arms 2112 are received in the first, the second, the third and the fourth receiving slots 16, the elastic arms 2112 of the first and the second contacts 21, 22 are exposed in the port 142, the elastic arms 2112 of the third and the fourth contacts are exposed in the opening 144.

When the mating connector (shown) is inserted, the mating connector contacts with the first and the second contacts 21, 22 and the touching portion 31 of the grounding piece 3 and presses the cantilever arm 143 to make the cantilever arm 134 press the elastic arm 2112 of the third contact 23 to electrically contact with the elastic arm 2112 of the fourth contact 24, so that a detection function is achieved.

Conjoined with FIG. 2, the rear seat 5 has a body 51 and a latching board 52 extending forwardly from a front edge of the body 51 and defining a plurality of through holes 53 passing through the latching board 52. The body 51 has a first step 55 and a second step 54 higher than the first step 55. The first step 55 and the second step 54 define a plurality of vertical passageways 58 for receiving the linking portion 212 of the contacts 2. The first step 55 has a vertical slot 56 for receiving the base 30 of the grounding piece 3.

The metal shell 4 is stamped from a metal piece and bent into a rectangular shape, comprising a front wall 41, a top wall 43 and two sidewall 42, the front wall 41 has a plurality of holes 411 corresponding to the tuber 141 of the insulative housing 1, and the sidewall 42 has a plurality of position legs 421.

Figure 7:
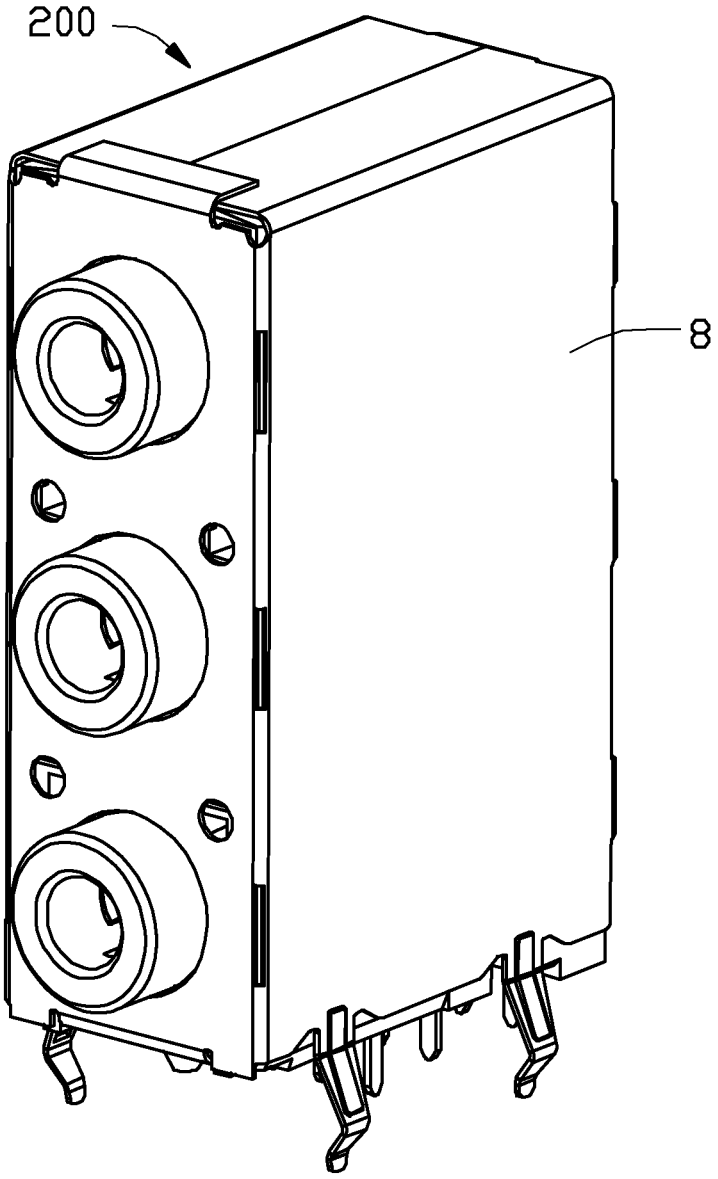
FIG. 7 is an assembled, perspective view of another electrical connector according to the present invention.
Figure 8:
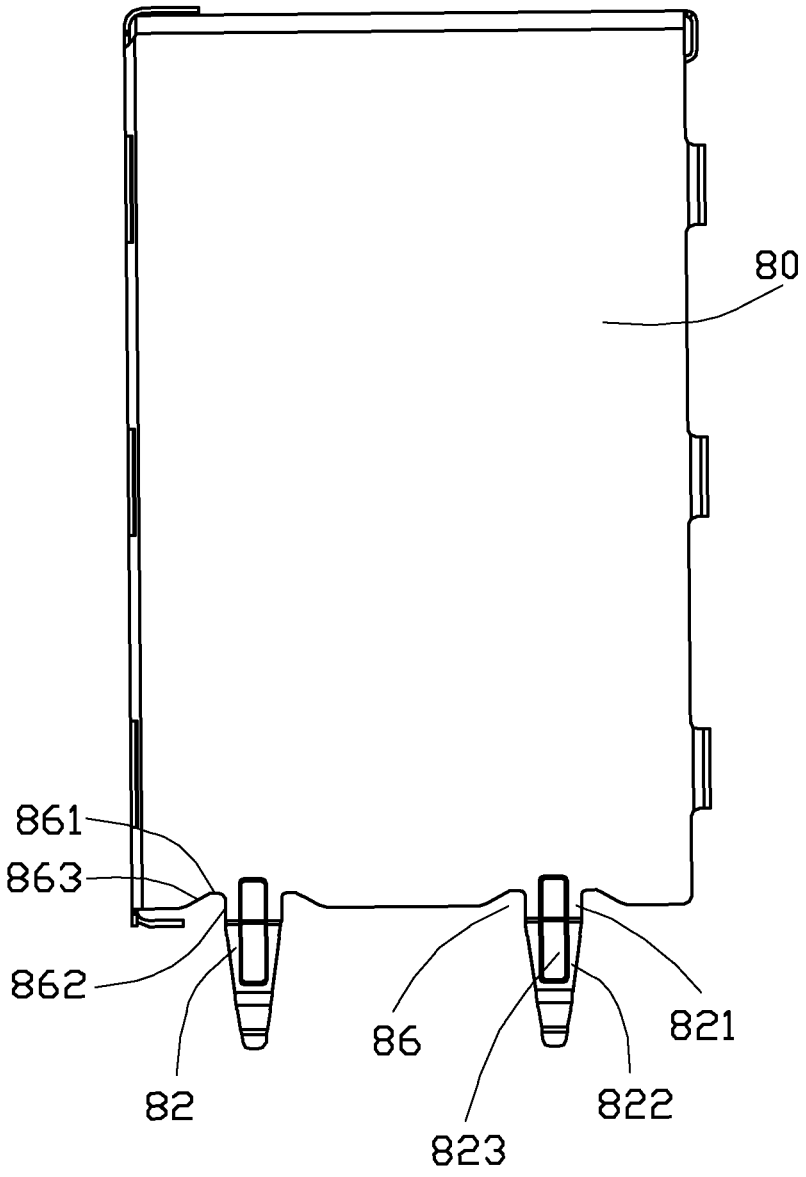
FIG. 8 is a side view of the electrical connector in FIG. 7.

FIGS. 7-8 provide another electrical connector 200 in accordance with present invention, the electrical connector 200 is same as the electrical connector 100 except for the metal shell 8 with a plurality of different position legs 80. The position legs 82 has a rectangular upper part 821 connecting with a sidewall 80 of the metal shell 8 and a trapezium lower part 822 with a gradually small sizes from the upper to lower direction. The sidewall 80 defines two gaps 86 beside the position leg 82. The gap 86 has a horizontal upper edge 861 and an inner vertical edge 862 which is a lateral edge of the rectangular upper part 821 and another inclined edge 863. The gap 86 downwardly passes through sidewall 80. A height of the gap 86 is 0.6 mm The position leg 82 has a rib 823 in a center thereof and extending from the rectangular upper part 821 to the trapezium lower part 822 to enhance the position leg 82. The design of the position leg 82 and the gap 86 can prevent the oxidation destruction to the position leg 82 from diffusing to the sidewall 85.

When assembly the electrical connector, first assemble the contacts 2 and the grounding piece 3 to the insulative housing 1 from the rear side, and then assemble the rear seat 5 to the insulative housing 1 from a bottom side, and put the caps 6 to the tubers 141 of the insulative housing 1, finally, make the metal shell 4 cover the insulative housing 1 and the cap 6 passes through the holes 411 if the metal shell 4 to be exposed outside.

Figure 9:
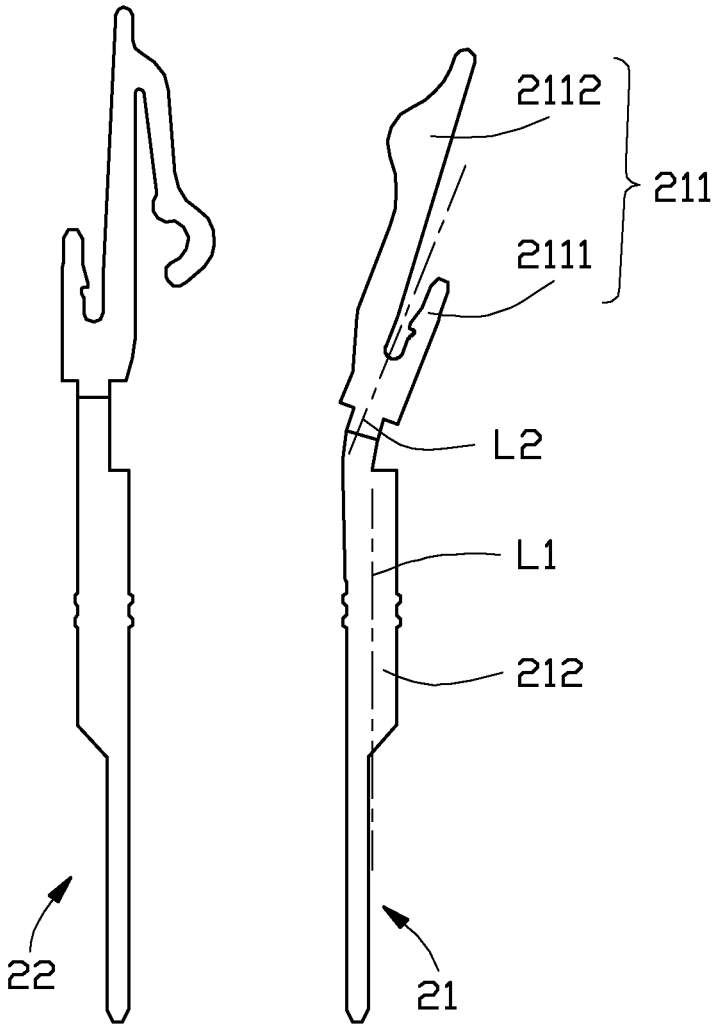
FIG. 9 shows the two contacts essentially oppositely arranged with each other wherein one extends horizontally while the other extends obliquely.

FIG. 9 shows the contact 21 and the contact 22 of the first embodiment in an unbending state. It is also noted that the vertical center axis L1 of the linking portion 212 and the oblique center axis L2 of the mating portion 211 is angled with each other. It is clear that after bending in the contact 21 the mating portion 211 extends in an oblique plane with a fork configuration composed of the elastic contacting arm 2112 and the fastening arm 2111. Notably, the bending line between the mating portion 211 and the linking portion 212 extends in an oblique direction in the aforementioned oblique plane. Differently, after bending in the second contact 22 the corresponding mating portion (not labeled) including the corresponding elastic contacting arm and the fastening arm, extends in a horizontal plane, and the bending line between the mating portion and the linking portion extends in a horizontal direction in the horizontal plane. Understandably, the oblique arrangement of the mating portion 211 of the first contact 21 may increase the width dimension of the mating portion for reinforcing the strength of the mating portion 211 within a limited space. On the other hand, the obliquely extending first slot 161 may compliantly increase the width dimension thereof too so as to leave more space for accommodating deflection/deformation of the first contact. The traditional horizontally extending slot and contact lack such advantages. In this embodiment, for the limited space consideration only the contact 21 is obliquely arranged because the contacting point of the contact 21 is located in front of the contacting point of the second contact 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing with a port and a plurality of contact slots;

a plurality of contacts mounted to the contact slots of the insulative housing, the contacts having two sound contacts and two detect pins, each contact formed with a linking portion extending downwardly beyond the insulative housing and a mating portion bent forwardly from the linking portion and extending into the port of the insulative housing, and the mating portions of the detect pins and one of the sound contacts being located at three different horizontal planes, while the other mating portion of the sound contact being located at an inclined plane relative to the horizontal planes;

the mating portion having a fastening arm and an elastic arm extending from a side of the fastening arm to form a fork shape with the fastening arm, the contact slot having a mounting slot recessed forwardly, the fastening arm of the contact being fixed into the mounting slot, and the elastic arm of the contact extending into the port; and a metal shell covering the insulative housing.

2. The electrical connector as claimed in claim 1, wherein the sound contacts have a first and a second contacts, the detect pins have a third and a fourth contacts, the first and the second elastic arms are staggered along a front to back direction, and the elastic arm of the third contact is located over the elastic arm of the fourth arm.

3. The electrical connector as claimed in claim 2, wherein the insulative housing has a plurality of tubers, each tuber defines one said port and is integrated with a cantilever arm extending into the port, the cantilever arm can press the elastic arm of the third contact to electrically contact with the elastic arm of the fourth contact.

4. The electrical connector as claimed in claim 1, further comprising a rear seat assembled to the insulative housing from a rear side, the rear seat has a first step and a second step higher than the first step, and the first step and the second step define a plurality of vertical passageways for receiving the linking portion of the contacts.

5. The electrical connector as claimed in claim 1, wherein the metal shell has a plurality of position legs, the position leg has a rectangular upper part connecting with the metal shell and a trapezium lower part with a gradually small sizes from the upper to lower direction, the metal shell defines a gap beside the position leg, the gap has a horizontal upper edge and an inner vertical edge which is a lateral edge of the rectangular upper part and another inclined edge.

6. The electrical connector as claimed in claim 5, wherein a height of the gap is 0.6 mm, the position leg has a rib extending from the rectangular upper part to the trapezium lower part to enhance the position leg.

7. An electrical connector, comprising:

an insulative housing with a port and a plurality of contact slots recessed from a rear face thereof; and a plurality of contacts, each contact formed with a linking portion extending downwardly beyond the insulative housing and a mating portion bent forwardly from a top of the linking portion, the mating portion having a fastening arm and an elastic arm forming a fork shape with the fastening arm, the mating portions being inserted into and fastened within the contact slots of the insulative housing, and the elastic arms extending into the port of the insulative housing, wherein at least one of contact slots is inclined so as to aslant dispose a corresponding mating portion;

further comprising a metal shell with a plurality of position legs, the position leg has a rectangular upper part connecting with the metal shell and a trapezium lower part with a gradually small sizes from the upper to lower direction, the metal shell defines a gap beside the position leg, the gap has a horizontal upper edge and an inner vertical edge which is a lateral edge of the rectangular upper part and another inclined edge.

8. The electrical connector as claimed in claim 7, wherein the contacts have two sound contacts and two detect pins, the mating portion of one of the sound contacts is aslant disposed in the at least one of contact slots.

9. The electrical connector as claimed in claim 8, wherein the contact slot has a mounting slot recessed forwardly, the fastening arm of the sound contact is fixed into the mounting slot, and the elastic arm of the sound contact extends into the port.

10. The electrical connector as claimed in claim 8, wherein the sound contacts have a first and a second contacts, the detect pins have a third and a fourth contacts, the first and the second elastic arms are staggered along a front to back direction, and the elastic arm of the third contact is located over the elastic arm of the fourth arm.

11. The electrical connector as claimed in claim 7, wherein a height of the gap is 0.6 mm, the position leg has a rib extending from the rectangular upper part to the trapezium lower part to enhance the position leg.

12. The electrical connector as claimed in claim 7, wherein the contact slot has a mounting slot recessed forwardly, the fastening arm of the contact is fixed into the mounting slot, and the elastic arm of the contact extends into the port.

13. An electrical connector comprising:

an insulative housing defining a mating port and a plurality of contact slots; and a plurality of contacts disposed in the contact slots of the housing and communicating with the mating port, one of said contacts including, viewed along a front-to-back direction, a vertically extending linking portion and a mating portion which is located above the linking portion in a vertical direction perpendicular to said front-to-back direction and extends in an oblique plane with an oblique bending line positioned between the mating portion and the linking portion and located in said oblique plane, wherein said mating portion includes an elastic contacting arm laterally extending into the mating port, and a fastening arm transversely spaced from the elastic contacting arm away from the mating port and securing to the housing; wherein said linking portion includes barbs on two sides in a transverse direction perpendicular to both said front-to-back direction and said vertical direction for securing the contact to the housing.

14. The electrical connector as claimed in claim 13, wherein said housing forms an obliquely extending slot to snugly receive said one contact.

15. The electrical connector as claimed in claim 13, wherein said mating portion forms a fork configuration.

16. The electrical connector as claimed in claim 13, wherein in an extended/unbending state, for said one contact a center axis of the mating portion extends in an oblique direction and is angled with a center axis of the linking portion which extends in said vertical direction angled with regard to the oblique direction.

17. The electrical connector as claimed in claim 13, wherein the elastic contacting arm is higher than the securing arm in said vertical direction.

18. The electrical connector as claimed in claim 13, wherein the contact slot has a mounting slot recessed forwardly, the fastening arm of the contact is fixed into the mounting slot, and the elastic contacting arm of the contact extends into the mating port.

19. The electrical connector as claimed in claim 13, wherein around the mating port there are four contacts respectively disposed in the corresponding four contact slots and arranged at upper and lower levels and two opposite first and second sides of the mating port, two of said four contacts are located at the upper level and the other two of said four contacts are located at the lower level, the contact located at the upper level and on the first side is higher than the contact located at the upper level and on the second side, and the contact locate at the lower level and on the first side is higher than the contact located at the lower level and on the second side.

20. The electrical connector as claimed in claim 19, wherein the mating portions of the two contacts located at the lower level extend horizontally while one of the mating portions of the two contacts located at the upper level extend horizontally while the other extends obliquely.

* * * * *